US005105600A

United States Patent [19]

DePoint, Jr. et al.

[11] Patent Number: 5,105,600

[45] Date of Patent: Apr. 21, 1992

[54] FLEXIBLE APPARATUS AND METHOD FOR ERECTING AND LOADING CASES

[75] Inventors: John DePoint, Jr., Palmyra; Michael L. Koelsch, Rochester; Gerald C. Pagorek, Holcomb, all of N.Y.

[73] Assignee: Eastman Kodak Company, Rochester, N.Y.

[21] Appl. No.: 625,578

[22] Filed: Dec. 11, 1990

[51] Int. Cl.[5] ..... B65B 5/10; B65B 61/20

[52] U.S. Cl. ..... 53/468; 53/157; 53/168; 53/238; 53/474

[58] Field of Search ..... 53/457, 458, 468, 472, 53/474, 168, 154, 157, 238, 237, 240, 201, 566, 564

[56] References Cited

U.S. PATENT DOCUMENTS

| | | | |
|---|---|---|---|
| 3,941,037 | 3/1976 | Reichert | 53/252 X |
| 4,035,989 | 7/1977 | Schuster | 53/186 |
| 4,067,172 | 1/1978 | Paules | 53/53 |
| 4,081,945 | 4/1978 | Calvert et al. | 53/186 |
| 4,109,444 | 8/1978 | Lee | 53/186 |
| 4,308,712 | 1/1982 | Hagedorn | 53/566 |
| 4,554,777 | 11/1985 | Denk et al. | 53/201 |
| 4,565,048 | 1/1986 | Lade | 53/201 |
| 4,677,808 | 7/1987 | Chenevard | 53/238 |
| 4,686,813 | 8/1987 | Sawada | 53/446 |
| 4,731,977 | 3/1988 | Maekawa | 53/443 |
| 4,751,805 | 6/1988 | Walter | 53/168 |
| 4,777,783 | 10/1988 | Zald | 53/447 |
| 4,864,801 | 9/1989 | Fallas | 53/446 |
| 4,887,412 | 12/1989 | Takamura | 53/504 |
| 5,019,112 | 5/1991 | Engelhardt et al. | 53/238 X |

*Primary Examiner*—James F. Coan
*Attorney, Agent, or Firm*—Charles E. Snee, III

[57] ABSTRACT

A flexible apparatus and method are disclosed for erecting cases and packaging a series of objects (26) which may be delivered in random order on an infeed conveyor (28), including a source (40,42) of a plurality of types of cases for such objects; a controller (48) for storing and providing information on the order of such objects; a station (32) for locating such cases for insertion of such objects; a programmable robot (34), responsive to such information, the robot having an end effector with a multiple purpose tool for selecting the type of case appropriate for a particular object in the series, for erecting the case and for placing the objects into the case; and a station (46) for closing and sealing the packed case.

10 Claims, 9 Drawing Sheets

FIG. 6
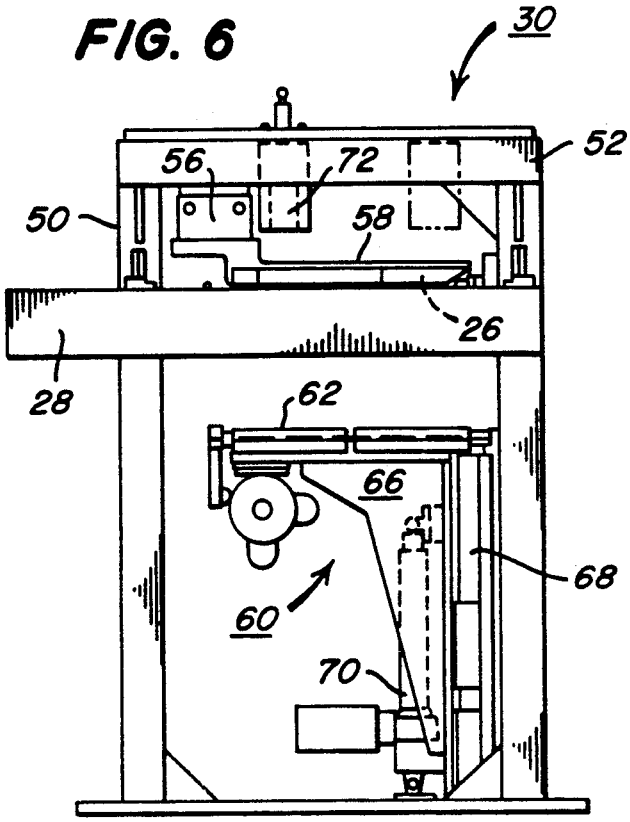
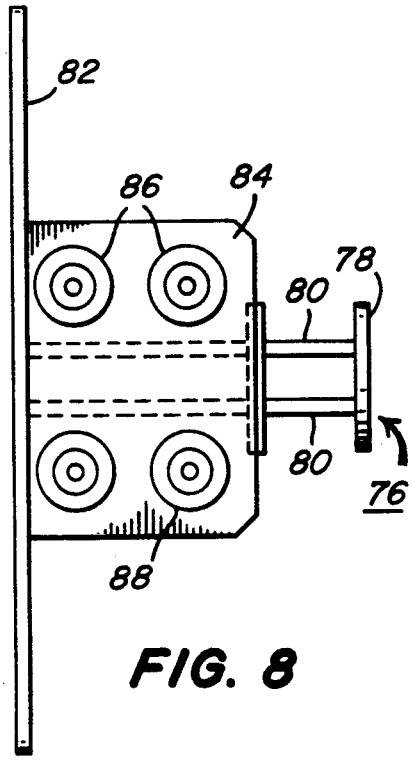
FIG. 8
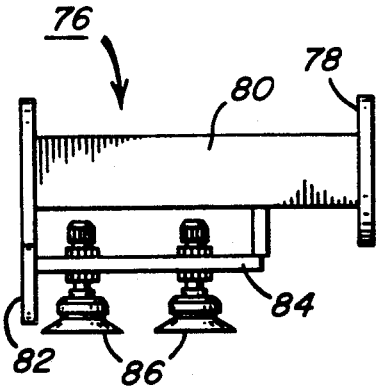
FIG. 7
FIG. 9
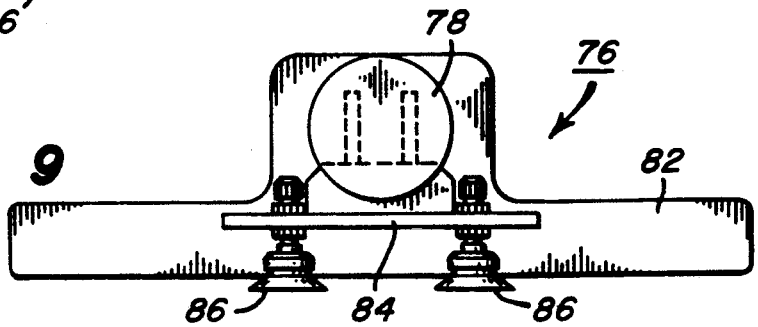

FLEXIBLE APPARATUS AND METHOD FOR ERECTING AND LOADING CASES

DESCRIPTION

1. Technical Field

The present invention concerns apparatus and methods for packaging objects. More particularly, the invention is related to apparatus and methods for automatically positioning or erecting cases for single objects or arrays of objects, placing such objects or arrays in the case and closing the case.

2. Background Art

Automatic and semi-automatic case packing apparatus have been known for many years. Typically, known apparatus of this sort has been dedicated to packing a particular object or product into a particular type of case at a relatively high speed. In some such apparatus, it is possible to shut down the apparatus and make various manual adjustments to configure the apparatus for a different type of product or case. For example, U.S. Pat. No. 3,941,037 discloses a case forming and transferring machine in which case blanks are removed from a stack, formed into open cases and filled with arrays of cans, after which the case is transferred to a sealing station. U.S. Pat. No. 4,035,989 shows a machine for erecting, filling and closing flat-foldable cases which is capable of processing cases of different sizes. U.S. Pat. No. 4,067,172 discloses a case set-up and loading machine in which a flat-foldable case is erected, closed at one end, filled with product and closed at the other end. U.S. Pat. No. 4,081,945 shows a packaging machine for use with cases of different sizes in which a vacuum powered picker mechanism pulls different types of cases from a hopper. U.S. Pat. No. 4,109,444 shows a horizontal packaging machine in which flat-foldable cases are erected, closed at one end while being loaded at the other and then sealed. U.S. Pat. No. 4,308,712 discloses a case blank folding apparatus in which the blank is partially folded, product is inserted and the blank is then folded about the product. U.S. Pat. Nos. 4,554,777 and 4,565,048 disclose convertible-format packaging machines in which a hand-held tool is used by the operator to adjust various portions of the machine for a change in case or product, in response to instructions from a controller. U.S. Pat. Nos. 4,686,813 and 4,731,977 disclose robot systems for packing cone shaped articles such as spools of thread or yarn, in which gantry type robots are used to gather and pack the spools. U.S. Pat. No. 4,777,783 shows an apparatus for accumulating and loading car body panels in which the panels are first stacked and transferred into a container. U.S. Pat. No. 4,864,801 discloses an automatic case packing apparatus in which arrays of products in flexible bags are plunged downward into an erected case. U.S. Pat. No. 4,887,412 shows a wrapping machine for six sided objects which is capable of applying wrappers of two different sizes.

While apparatus of the types shown in the patents discussed above has received a considerable degree of commercial acceptance, a need has continued to exist for packing equipment which is capable of receiving and packing a frequently changing series of products which must be placed in different sizes of cases, either singly or in different types of arrays, and with or without dunnage inserts to fill void space in the case.

SUMMARY OF THE INVENTION

A primary objective of the invention is to provide an apparatus and method for packaging or packing objects which can automatically, or with minimal operator intervention, adjust for changes in the type of product to be packed, the size of case to be used and the amount of dunnage to be added to a given case.

A further objective of this invention is to provide such an apparatus and method which can be readily programmed to a wide variety of products, cases and dunnage.

Still another objective of this invention is to provide such an apparatus and method which can pack cases by pushing products horizontally or lowering them vertically into the cases.

Yet another objective of this invention is to provide such an apparatus and method which can insert with the products, dunnage layers on the sides or tops of, or interleaved with, the products.

These objectives are given only by way of illustrative examples; thus other desirable objectives and advantages inherently achieved by the disclosed invention may occur or become apparent to those skilled in the art. Nonetheless, the scope of the invention is to be limited only by the appended claims.

The apparatus according to the invention comprises means, such as a conveyor, for providing a series of a plurality of different types of such objects; a first source, such as a carousel with several bins, of a plurality of different types of cases for receiving such objects; means, such as a host computer or a programmable controller for the robot used in the apparatus, for storing and providing information on the order of such objects in the series to be provided; means, such as an assembly table with vacuum elements for holding the case, for locating such cases for insertion of such objects; programmable robot means, responsive to the means for storing and providing, for selecting a type of case from the first source, the selected case being appropriate for the order of such objects in the series and placing such type of case at said means for locating; means for inserting such objects into such type of case; and means for closing such type of case following such inserting. The robot may be used to insert such objects, or they may be inserted by a separate mechanism.

The apparatus of the invention may further comprise means, such as a stacker elevator, for accumulating a plurality of such objects in arrays for insertion into such type of case. Typically, such cases are collapsed when selected from the first source; the means for locating locates such collapsed cases for erection prior to insertion of such objects and the programmable robot means erects such case at the means for locating. In a preferred embodiment, the apparatus of the invention also comprises a second source of dunnage inserts for such cases to accomodate different types of such objects; and means for holding such dunnage inserts in position for insertion into such type of case. In such preferred embodiment, the programmable robot means also performs the functions of selecting appropriate dunnage inserts from the second source and placing such dunnage inserts at the means for holding. Means, which may be comprised in the programmable robot or in a separate mechanism, are provided for inserting such dunnage inserts into such cases with such objects. Alternatively, the dunnage inserts may be placed on top of or interleaved with the objects. In all embodiments, the apparatus of the invention can pack objects singly or in arrays such as vertical stacks or horizontal groups and, depending on the objects, can insert them into cases either horizontally or vertically.

In accordance with the method of the invention, a series of a plurality of different types of objects is provided for packing; and information on the order or sequence of such series is provided and stored. A plurality of different types of cases is provided for receiving such objects. Using a programmable robot, cases are selected in response to such information and located for insertion of such object as the objects are received in such series. Where flat-foldable cases are used, the same robot erects the case to receive such objects. Using a programmable robot or a separate mechanism, the objects are inserted into the case and the case is moved to a location where its end flaps are closed and sealed.

BRIEF DESCRIPTION OF THE DRAWINGS

The foregoing and other objectives, features and advantages of the invention will be apparent from the following more particular description of the preferred embodiments of the invention, as illustrated in the accompanying drawings.

FIG. 6 is a right end view of the apparatus of FIG. 4.

FIG. 7 is a side view of the tool for the first programmable robot.

FIG. 8 is a bottom view of the tool of FIG. 7.

FIG. 9 is a right end view of the apparatus of FIG. 7.

DESCRIPTION OF THE PREFERRED EMBODIMENTS

Figure 1:
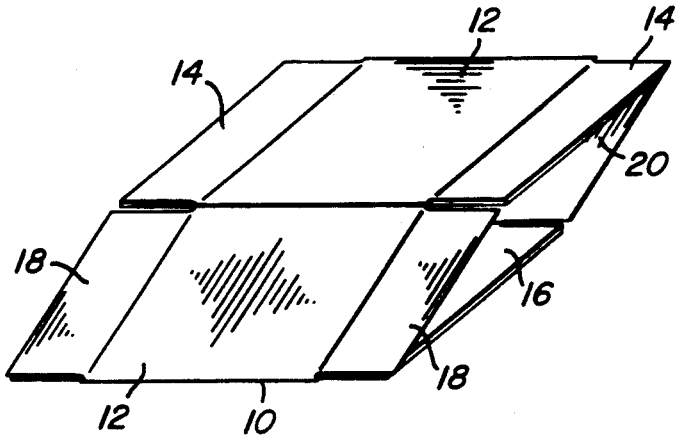
FIG. 1 is a perspective view of a flat-foldable case of a type useful with the present invention.

The following is a detailed description of the preferred embodiments of the invention, reference being made to the drawings in which the same reference numerals identify the same elements of structure in each of the several Figures.

FIG. 1 shows a partially erected, flat-foldable case 10 of the general type suitable for use in the present invention. Such cases comprise four right rectangular body panels 12 joined flexibly at their edges in the known manner, plus conventional top and bottom end flaps 14,16 and side end flaps 18,20 hinged to the body panels. In use, such cases are pulled to an open configuration to permit product to be inserted, after which the end flaps are closed and the completed case is taped or otherwise sealed to complete the package.

Figure 2:
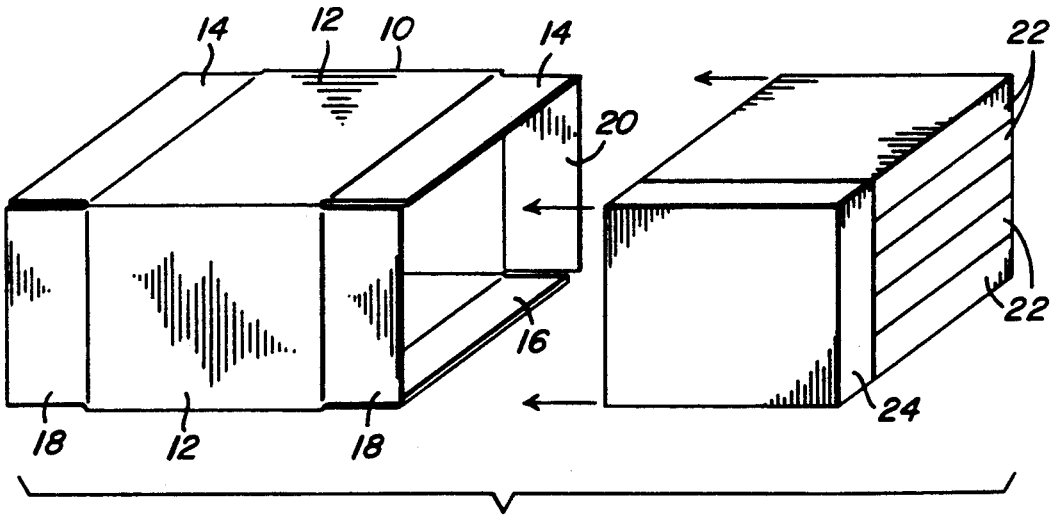
FIG. 2 is a perspective view of such a case after erection, with an array of product and a dunnage element ready for horizontal insertion.

FIG. 2 shows such a case as erected, with an array of products 22, such as a vertical stack of right rectangular boxes. Where the array of products is too small for the case, one or more dunnage elements 24 may be provided where needed to fill the case and prevent jostling of the products. Dunnage elements 24 may be rectangular sheets of corrugated cardboard in single or multiple thicknesses, or expanded plastic foam, or pressboard, for example. Dunnage elements may be configured as perimeter pads, as shown, or as wrap-around or interleaved pads. When the desired configuration of products and dunnage has been assembled, it is pushed into the erected case, after which the end flaps are closed and the case is sealed.

Figure 3:
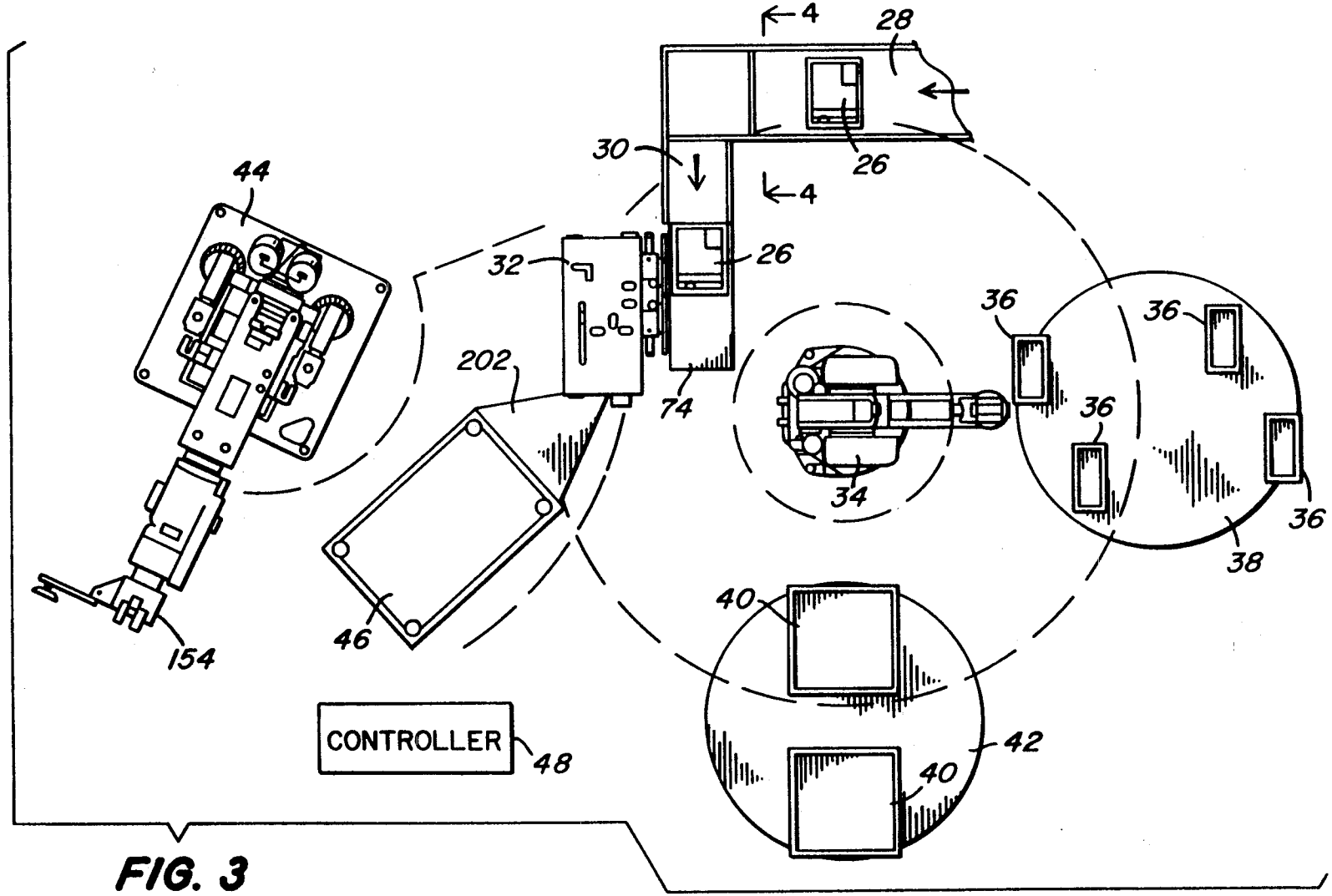
FIG. 3 is a plan view of the apparatus of the invention, illustrating one arrangement of infeed conveyor, accumulator, source of dunnage inserts, source of cases, first programmable robot, case locating table, transfer table, case taper and second programmable robot.

In accordance with the present invention, a wide variety of products in various arrays can be automatically packed using a variety of cases requiring a variety of dunnage elements, with little or no need for operator intervention due to changes in the type of product or the type of case, or both. FIG. 3 shows a plan view of the apparatus of the invention in which a series of products 26 is delivered by a conventional infeed conveyor 28. Depending on the particular application of the invention, such series of products may change rather frequently from one product to another, with each product type to be packed differently or groups of different product to be packed together or the like. Products 26 are pushed from conveyor 28 to a suitable accumulator 30, which may be a stacking elevator of the type illustrated in FIGS. 4 to 6 for grouping the products in a vertical array or a conventional mechanism, not illustrated, for grouping several products in a horizontal array. As used in this specification, the term array refers to either a horizontal or a vertical grouping of products or objects. Of course, where the particular product is large enough to fill a case by itself, no accumulating of product will be necessary.

From accumulator 30, the product or array of products is moved before a case locating and erecting table 32. While the product or array of products has been approaching table 32, a first conventional programmable robot 34, preferably of the type having at least five, preferably six, degrees of freedom of movement such as Model IRB 3000 made by Asea-Brown Boveri, using a tool of the type illustrated in FIGS. 7 to 9, has selected any necessary dunnage elements from one or more of a plurality of bins 36 in a carousel 38, illustrated only schematically, and has positioned the dunnage elements at table 32 in a manner to be described with respect to FIGS. 10 to 13. If the case is to be only partially filled, dunnage elements may also be placed by robot 34 on top of the array of products. Then, robot 34 has selected the appropriate case from one of a plurality of bins 40 in a carousel 42, illustrated only schematically, has positioned the case on table 32, and has erected the case to the general configuration shown in FIG. 2. Although the use of flat-foldable cases is preferred in the apparatus of the invention, cases which have already been erected also may be located and packed using the apparatus and method of the invention. After the product or array of products has been positioned opposite table 32, robot 34 pushes the product or array of products and any selected dunnage elements into the erected case and pushes the filled case further onto table 32 to a location where the side end flaps 18 at the far end of the case may be closed. Alternatively, a separate mechanism such as a pneumatic cylinder and pusher plate, not illustrated, may be used to push the product or array of products and any dunnage elements into the erected case, after which robot 34 performs in the manner previously described.

Figure 14:
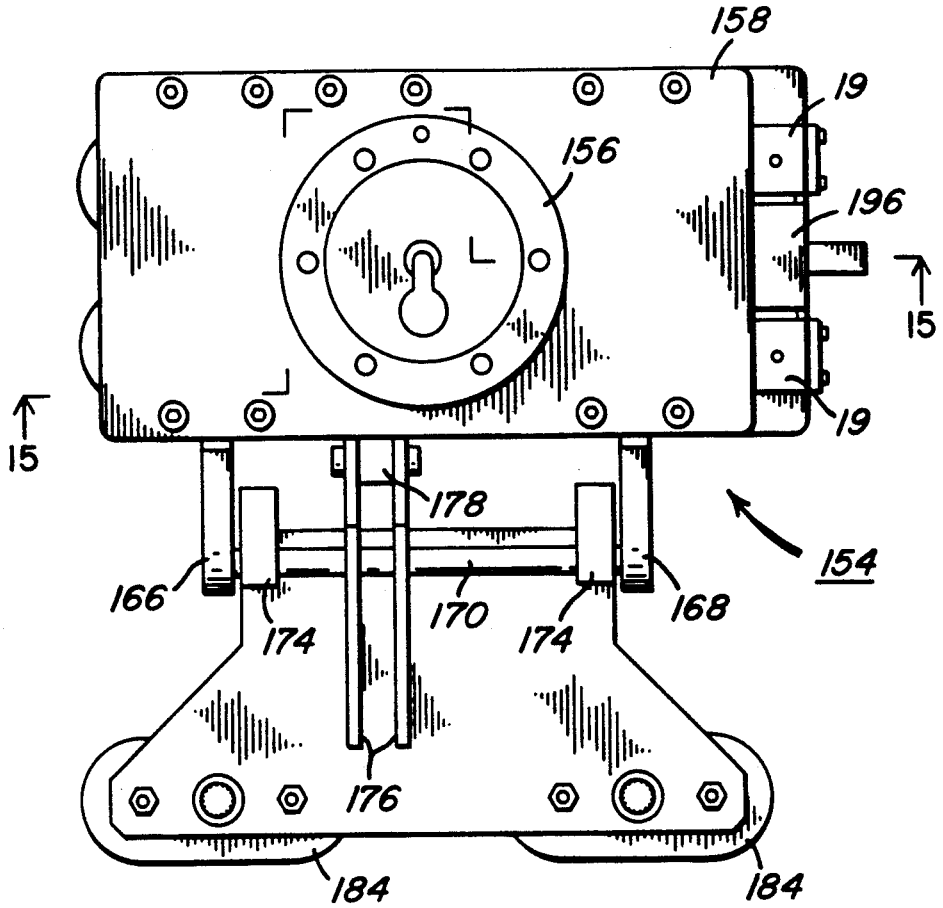
FIG. 14 is a top view of the tool for the second programmable robot.
Figure 15:
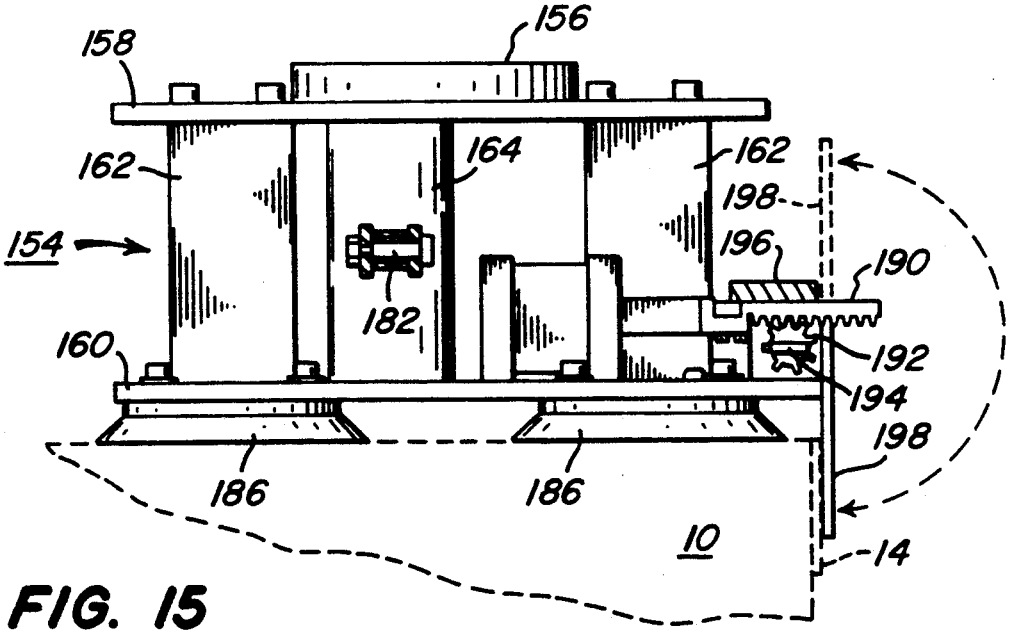
FIG. 15 is a side view of the tool of FIG. 14, partially in section, taken along line 15—15 of FIG. 14.
Figure 16:
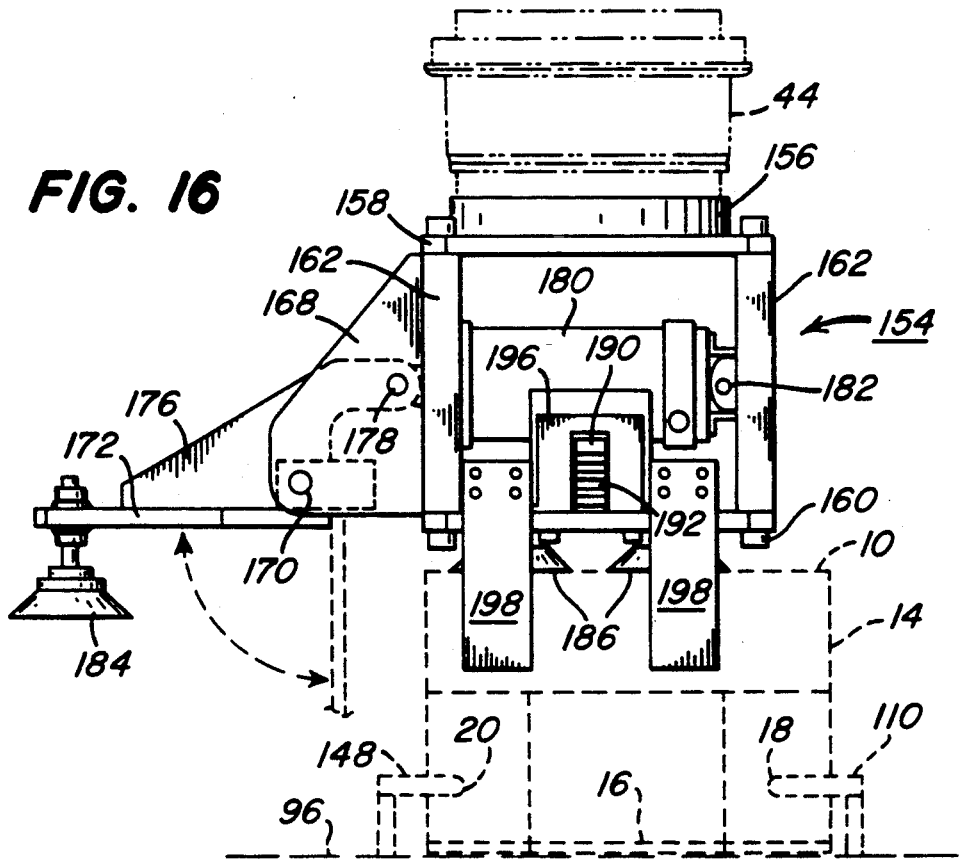
FIG. 16 is a right end view of the tool of FIG. 14.

At this point, a second conventional programmable robot 44, also preferably of the type having at least five, preferably six, degrees of freedom of movement such as Model IRB 90 made by Asea-Brown Boveri, using a tool of the type illustrated in FIGS. 14 to 16, closes the remaining end flaps on the far end of the case, uprights the packed case and slides the case from table 32 to a conventional case taping station 46, shown only schematically, where the remaining open end flaps are closed and both sets of end flaps are sealed. A suitable taping station would be the Model LD-14A made by The Loveshaw Corporation of Ronkonkoma, N.Y., U.S.A. and sold under the tradename "Little David". Robot 44 may thereafter place the completed package on a pallet and place completed pallets on an outfeed conveyor, not illustrated. Although the use of a pair of programmable robots is preferred, it also is within the scope of the invention to use only robot 34 to upright the packed case and transfer it to taping station, though a change of robot tools and some rearrangement of the equipment could be necessary. It is also within the scope of the invention to use robot 34 only to erect and load the case vertically, rather than horizontally as illustrated, and then to transfer the loaded vertical case to the taping station.

The overall operation of the apparatus preferably is coordinated and synchronized by a host programmable controller 48, such as a general purpose computer, which controls the operation of infeed conveyor 28, accumulator 30, robot 34, carousels 38,42, locating table 32, robot 44 and taping station 46. Controller 48 stores and provides to the components of the apparatus information on the order or sequence of the series of products being delivered on infeed conveyor 28 and the various arrays or combinations in which such products are to be placed in cases. The various components of the apparatus then operate in accordance with such information. In the case of robots 34,44, programmable controllers at each robot may be provided in the familiar manner with a variety of instructions for various combinations of products and cases and then actuated by controller 48; or the instructions may be stored in controller 48 and downloaded to the robots when needed. The programming of controller 48 or robots 34,44 or both is well within the skill of those in the art once they have become acquainted with the unique mode of operation of the apparatus of the invention.

Figure 4:
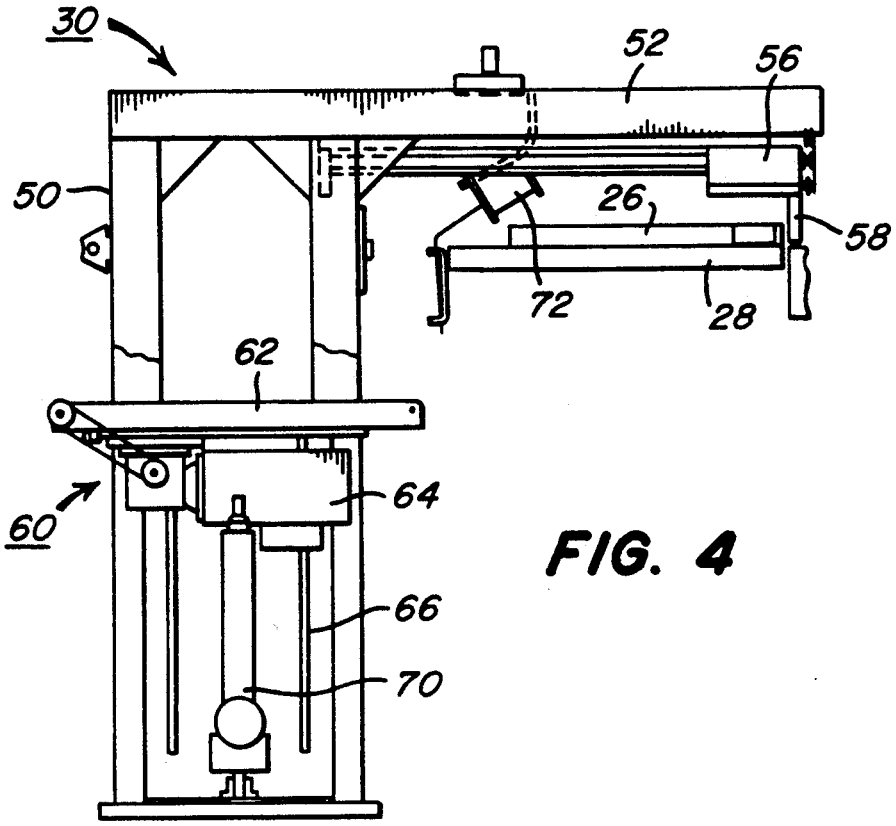
FIG. 4 is an elevation view of a type of accumulator apparatus useful in the present invention, taken along line 4—4 of FIG. 3.
Figure 5:
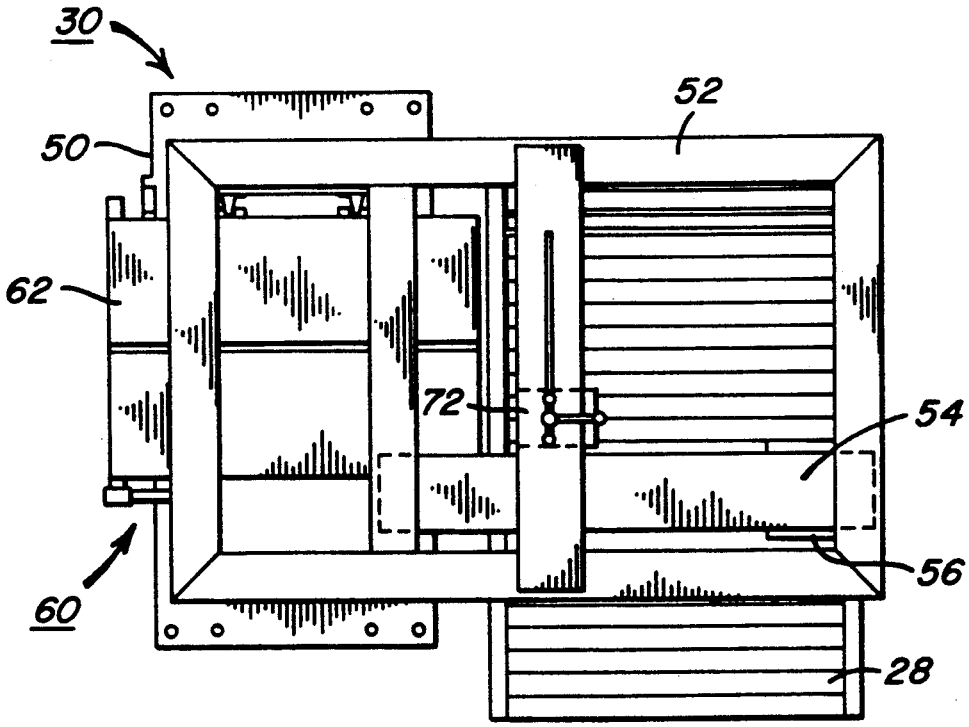
FIG. 5 is top view of the apparatus of FIG. 4.

FIGS. 4 to 6 illustrate an accumulator 30 of a type suitable for use in the apparatus of the invention. An upstanding frame 50 of rigid metal box tubing comprises a laterally extending portion 52 which passes over the end portion of infeed conveyor 28. On the underside of portion 52, a guide rail assembly 54 supports a carriage 56 on which is mounted an elongated pusher bar 58 for engaging products on infeed conveyor 28. Carriage 56 can be driven back and forth on rail assembly 54 by means such as a pneumatic cylinder, not illustrated. Thus, as carriage 56 is moved to the left as illustrated in FIG. 4, a product 26 at the end of conveyor 28 will be pushed sideways onto a stacker elevator 60. As shown in FIGS. 4 and 6, elevator 60 comprises a transfer conveyor 62 having horizontal belts driven by a motor 64. Elevator 60 is mounted for movement up and down on a carriage 66 supported on a vertical track 68. A hydraulic or pneumatic motor 70 is connected between frame 50 and carriage 66 and serves to raise and lower conveyor 62. In FIGS. 4 and 6, conveyor 62 is positioned below the level of infeed conveyor 28; however, in operation the upper surfaces of the belts of conveyor 62 are positioned essentially coplanar with infeed conveyor 28; so that, the first product of a vertical array is pushed directly onto the belts. Conveyor 28 is then lowered until the upper surface of the first product is essentially coplanar with infeed conveyor and a second product is pushed onto the first product. This process is then repeated until the desired number of products has been stacked or accumulated on conveyor 62. As each product leaves infeed conveyor 28, a bar code scanner 72 scans a code on the package and signals controller 48 of the passing of that product. When the desired product or array of products has been transferred to accumulator 30, conveyor 62 is positioned at the height of a transfer conveyor 74, shown schematically in FIG. 3. Conveyor 62 is then driven by motor 64 to place the array on conveyor 74 which delivers the array to case locating and erecting table 32. Conveyor 62 then receives the first product of the next array of products.

The end effector of robot 34 is fitted with a tool 76 of the type shown in FIGS. 7 to 9. A flange 78 is provided for attachment to the end effector of robot 34 and, in the conventional manner, is provided with pneumatic connectors, not illustrated, for connection to vacuum lines of the robot. Extending from and rigidly attached to flange 78 is a pair of essentially parallel bars 80 at whose opposite end is attached a transversely extending pusher bar or plate 82. The horizontal length of plate 82, as viewed in FIG. 9 is chosen to be somewhat less than the width of the opening of the widest erected case to be filled, thereby permitting plate 82 to enter a case if necessary. The vertical height of the side portions of plate 82, as viewed in FIG. 9, is chosen to be somewhat less than the width of the opening of the narrowest erected case to be filled. A bracket 84 is suspended beneath bars 80 to support a plurality of conventional suction cups 86, whose lower edges are positioned just below the lower edge of pusher plate 82. Suction cups 86 may be connected through flange 78 to the vacuum lines of the robot. In use, suction cups 86 are pressed into contact with a surface of dunnage elements 24 or cases 10 and vacuum is applied to enable robot 34 to pick up a dunnage element or case and deliver it to table 32. As will be described in more detail, pusher plate 76 is used to move a product or array of products into an erected case.

Figure 10:
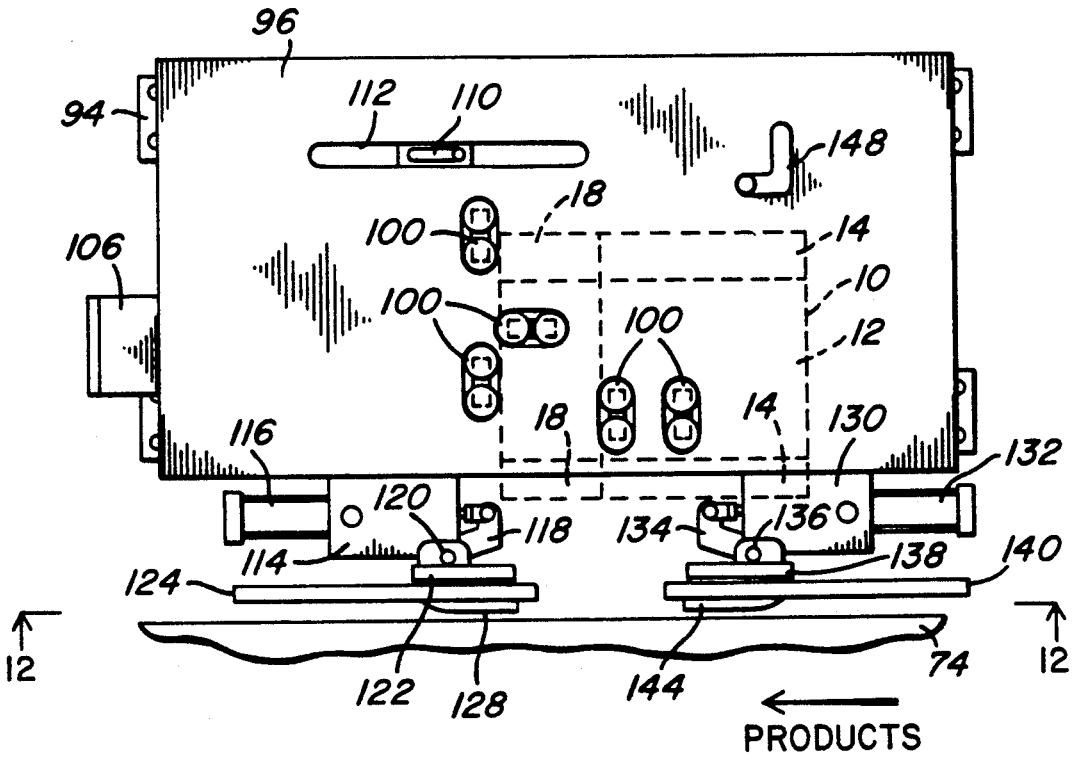
FIG. 10 is a plan view of a type of case locating table useful in the present invention, with its dunnage holders in the retracted, closed position.
Figure 12:
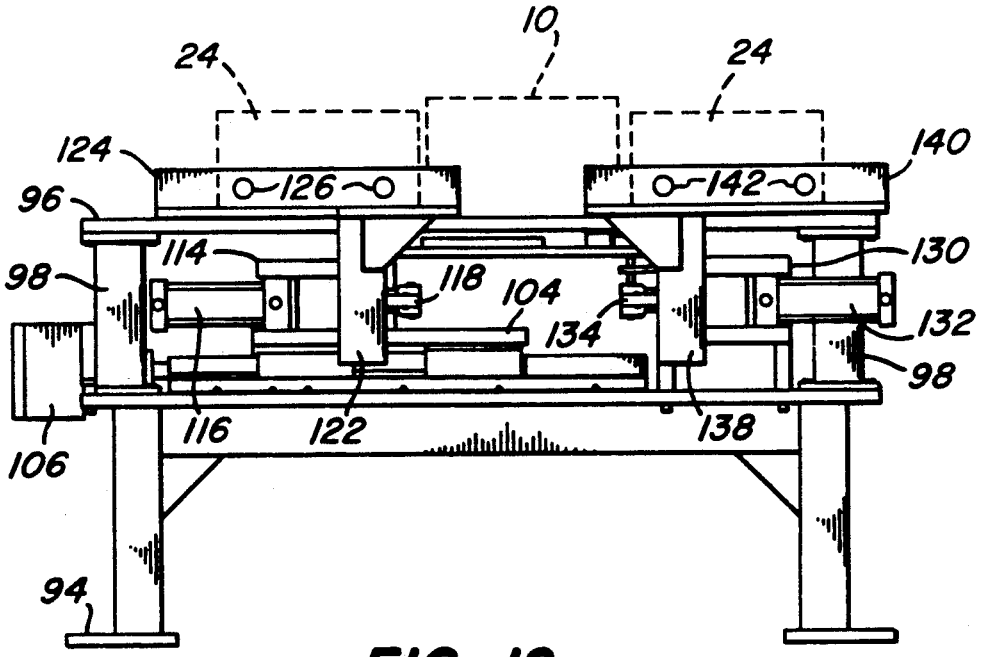
FIG. 12 is a front elevation view taken along line 12—12 of FIG. 10.
Figure 11:
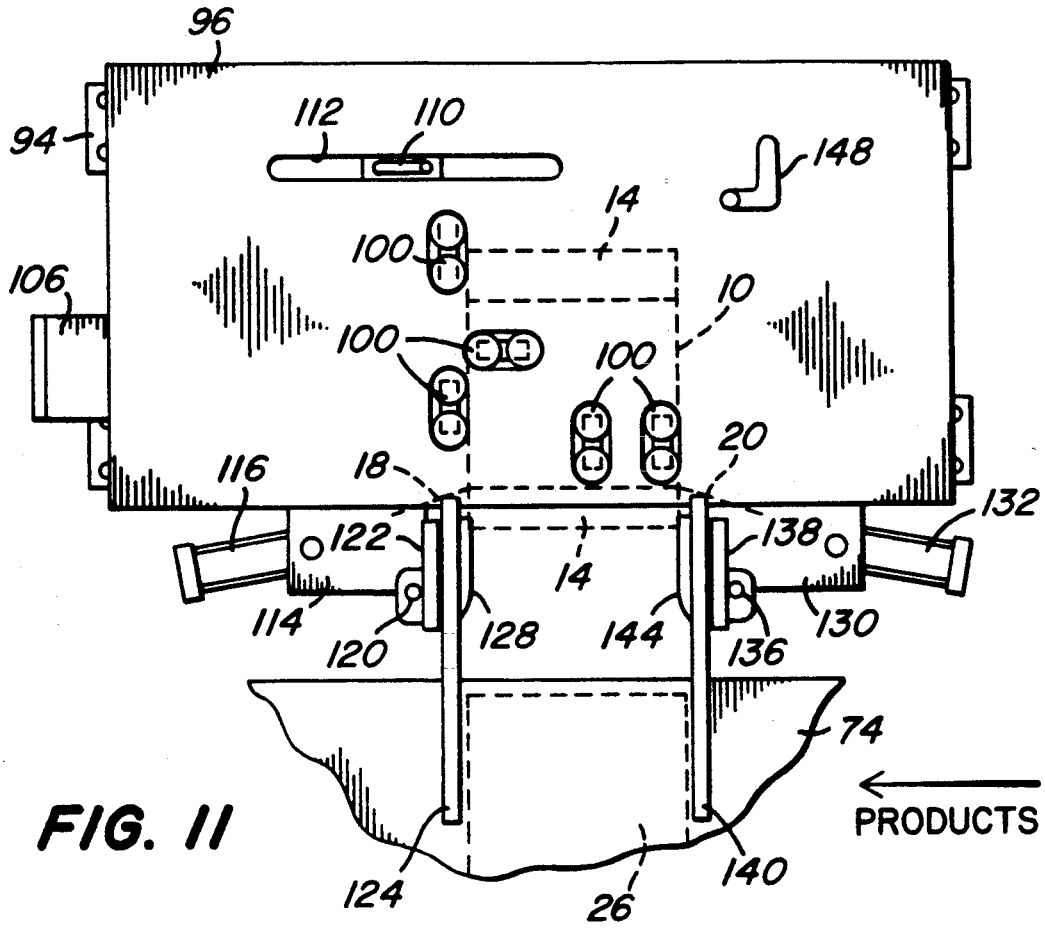
FIG. 11 is plan view of the apparatus of FIG. 10, with its dunnage holders in the open position.
Figure 13:
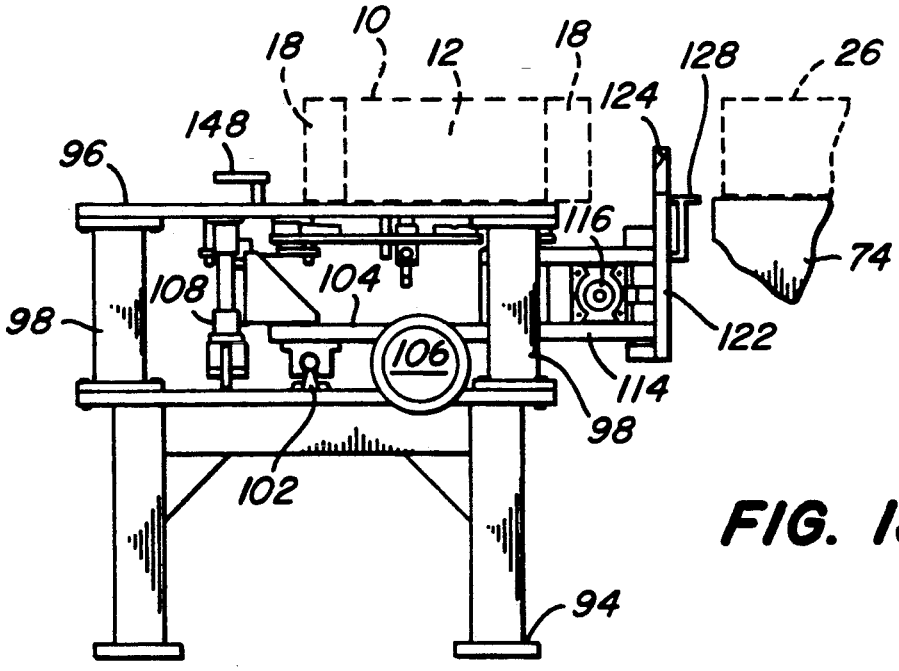
FIG. 13 is a left end view of the apparatus of FIG. 10.

Case locating and erecting table 32 is illustrated in greater detail in FIGS. 10 to 13. A table-like base frame 94 supports a further table-like structure comprising a rectangular top plate 96 having corner legs 98 attached to frame 94, the length of legs 98 being chosen to place the top surface of plate 96 in essentially the same plane as the upper surface of conveyor 74. Through top plate 96 are provided a plurality of openings in which are mounted retractable suction cups 100 in an array selected to enable the cups to firmly grasp one side panel 12 of each size of flat-foldable case to be erected and filled using the apparatus of the invention. In FIG. 10, a flat-folded case 10 of the type illustrated in FIG. 1 is shown in phantom on the surface of top plate 96, before the case has been erected by robot 34. The integral hinges between end flaps 14 and 18 are positioned approximately in line with the edge of top plate 96 which runs parallel to conveyor 74. In FIGS. 11, 12 and 13, case 10 is shown in phantom in its open or erected position, to which it has been moved by robot 34. In the positions shown in FIGS. 10 to 13, the case is located near to conveyor 74 to receive products 26; however, once the products have been pushed into the erected case, the case and products are moved across the surface of top plate 96 to a position where robot 44 is used for closing of the end flaps farther from conveyor 74, uprighting of the case and moving of the uprighted case to taping station 46.

Beneath top plate 96, base frame 94 supports a pair of parallel rails 102, a different one of which is shown in each of FIGS. 12 and 13. Mounted on rails 102 is a carriage table 104 which can be moved back and forth beneath top plate 96 by means of a lead screw assembly, not illustrated, driven for example by a servo motor 106. Near its edge farther from conveyor 74, carriage table 104 supports an upwardly extending actuator 108 which is operatively connected to an end flap closing arm 110 which is positioned within a slot 112 through top plate 96 and parallel to rails 102. Actuator 108 preferably is pneumatically actuated and is of the known type which can extend a rod on which arm 110 is mounted and then rotate the rod to move arm 110 into contact with an end flap.

Near its edge nearer to conveyor 74, carriage table 104 rigidly supports a subframe 114 comprising a pair of parallel plates which extend past the edge of top plate 96 toward conveyor 74 and pivotably support the head end of a pneumatic actuator 116. A crank arm 118 is pivotably attached at one end to the rod end of actuator 116 and fixedly attached at the other end to a vertically extending axle 120 supported in bearings by subframe 114. A vertically extending pivot plate 122 is fixedly attached for rotation with axle 120 and supports at its upper end a horizontally extending dunnage support and guide plate 124. Along its side facing conveyor 74, as viewed in FIGS. 10, 12 and 13, support and guide plate 124 is provided with a pair of suction cups 126 for gripping the vertical surface of one side of dunnage elements 24. Along its lower edge opposite axle 120, support and guide plate 124 is provided with a horizontally extending guide plate 128 for supporting the lower edge of dunnage elements 24. Directly opposite to subframe 114 on carriage 104, base frame 94 supports a fixed subframe 130 comprising a pair of parallel plates which extend past the edge of top plate 96 toward conveyor 74 and pivotably support the head end of a pneumatic actuator 132. A crank arm 134 is pivotably attached at one end to the rod end of actuator 132 and fixedly attached at the other end to a vertically extending axle 136 supported in bearings by subframe 130. A vertically extending pivot plate 138 is fixedly attached for rotation with axle 136 and supports at its upper end a horizontally extending dunnage support and guide plate 140. Along its side facing conveyor 74, as viewed in FIGS. 10, 12 and 13, support and guide plate 140 is provided with a pair of suction cups 142 for gripping the vertical surface of one side of dunnage elements 24. Along its lower edge opposite axle 136, support and guide plate 140 is provided with a horizontally extending guide plate 144 for supporting the lower edge of dunnage elements 24. Thus, if both actuators 114 and 140 extend their rods at the same time, support and guide plates 124, 140 will swing to the positions illustrated in FIG. 11, where they preferably extend substantially across conveyor 74. Finally, essentially opposite to end flap closing arm 110, is mounted a pivotable end flap closing arm 148 which may be positioned constantly above the surface of top plate 96, as illustrated in FIG. 13, or may be made retractable as in the case of arm 110.

The apparatus of FIGS. 10 to 13 is used in the following manner. Robot 34 selects from bins 36 the dunnage elements 24 which are needed to package the particular product 26 or array of products to be delivered. Dunnage elements are then placed against suction cups 126, 142 and rested on horizontal guide plates 128, 144. Robot 34 then selects from bins 40 the flat-foldable case 10 needed for the particular product or array of products and, while suction cups 86, 88 hold that case by what will become the top panel 12 of the erected case, places that case on top plate 96 so that suction cups 100 will securely grip what will become the bottom panel 12 of the erected case. Robot 34 then lifts the top panel of the case so that the case opens to the erected configuration shown in FIGS. 2 and 11 to 13. Actuator 116 then extends its rod to cause support and guide plate 124 to swing to the open position shown in FIG. 11. As shown in FIG. 11, as support and guide plate 124 moves to the open position, its end closest to axle 120 contacts and deflects side end flap 18 of the case, shown in phantom, thus preventing the case from collapsing back to its initial, flat-folded configuration. With the case secured against collapsing, robot 34 releases the top panel of the case and repositions itself to push the products into the case. Next, an array of products 26 is delivered by conveyor 74, which stops when the array just reaches support and guide plate 124, where the array is positioned to move directly into the open case. Actuator 132 then extends its rod to cause support and guide plate 140 to swing to the open position shown in FIG. 11; so that, the array of products is captured between the two support and guide plates, with the support and guide plates essentially aligned with the interior side walls of the case to ensure that the array will move straight into the case. Robot 34 then orients tool 76 so that it can pass between support and guide plates 124, 140 and push the array of products and the dunnage elements into the erected case. The case and its contents are then pushed across the surface of top plate 96 to a position, not specifically illustrated, where end flap closing arms 110, 148 can be rotated into contact with side ends flaps 18, 20 at the end of the case farther from conveyor 74, as shown in phantom in FIG. 16. Robot 34 then withdraws to pick up dunnage 24 and case 10 for the next array of products.

Should the type of product or array change, the apparatus of the invention readily adjusts without requiring operator intervention. When the last product of a given type is sensed by scanner 72, controller 48 responds to this information when that last product has been packed, by actuating motor 106 to simultaneously reposition carriage 104, end flap closing arm 110 and dunnage support and guide plate 124 to the proper positions for the case for the next type of product in the series being delivered by infeed conveyor 28. Controller 48 also repositions carousels 38 and 42 as necessary and instructs robots 34 and 44 as necessary for the new product.

Once a particular case has been packed, robot 44 takes over, using the tool 154 illustrated in FIGS. 14 to 16. The end effector of robot 44 is attached to tool 154 by means of an attachment flange 156 attached to a top plate 158. A bottom plate 160 is positioned parallel to top plate 158 by four corner spacer blocks 162 and a single cylinder pivot block 164, the latter being attached between the edges of the top and bottom plates on one side of tool 154. On the side opposite to pivot block 164, corner blocks 162 support a pair of spaced, parallel pivot braces 166, 168 which rotatably support a shaft 170. Fixedly attached to shaft 170 is a plate-like lever arm 172 which rigidly supports a pair of spaced pivot blocks 174 which preferably are pinned to shaft 170. A pair of crank arms 176 extend outwardly from lever arm 172 between pivot blocks 174 and are provided with bores which loosely surround shaft 170. The outer ends of crank arms 176 are pivotably attached to the rod end 178 of a pneumatic actuator 180 whose head end 182 is pivotably attached to pivot block 164. Thus, when actuator 180 extends its rod, lever arm 172 rotates downward to the position shown in phantom in FIG. 16. On its side opposite to crank arms 176, lever arm 172 supports an array of suction cups 184 which, after lever arm 172 has been rotated downward, will grip the erect case on its side panel which faces accumulator 30. On the underside of bottom plate 160, as viewed in FIGS. 15 and 16, an array of suction cups 186 is provided for gripping the erect case on its top panel, as indicated in phantom in FIGS. 16 to 18. To close the top end flap 14 at the end farther from conveyor 74, tool 156 further is provided with a pneumatic actuator 188 mounted on bottom plate 160. The rod end of actuator 188 is rigidly attached to a gear rack segment 190 which engages a pinion gear 192 fixed to a shaft 194 mounted for rotation in a pair of bearings 196. The ends of shaft 194 extend beyond bearings 196 and rigidly support a pair of top flap closing arms 198. Thus, when actuator 188 extends its rod, rack segment 190 causes gear 192 and shaft 194 to rotate and bring top flap closing arms downward to the position shown in FIGS. 15 and 16 where top end flap 14 has been folded downward.

Figure 17:
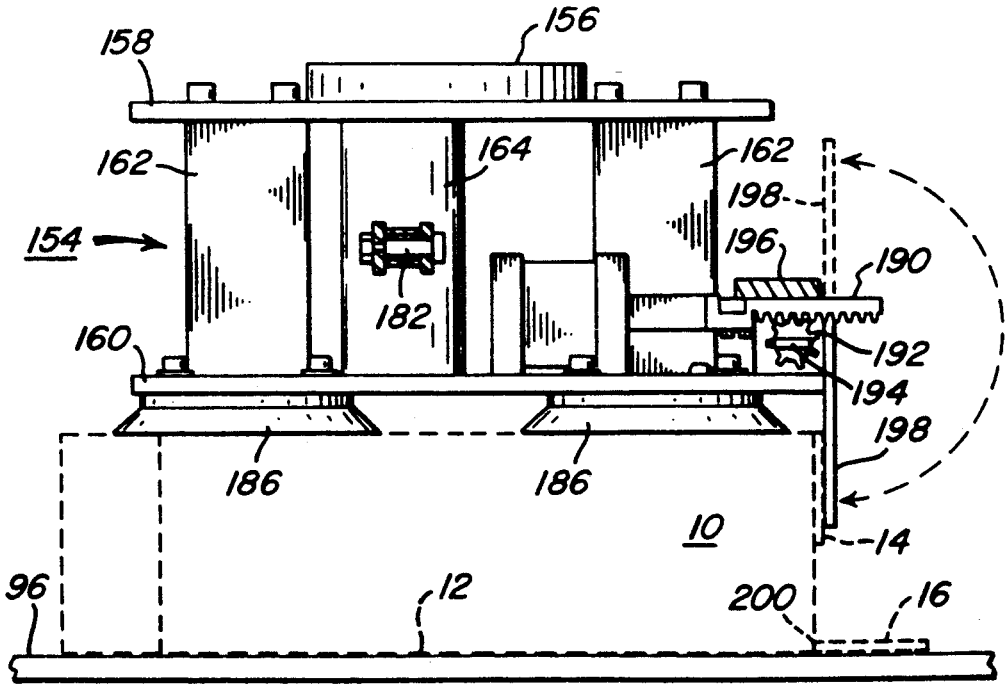
FIG. 17 is an elevation view of a loaded case, shown in phantom, which has been gripped by the tool of the second programmable robot.
Figure 18:
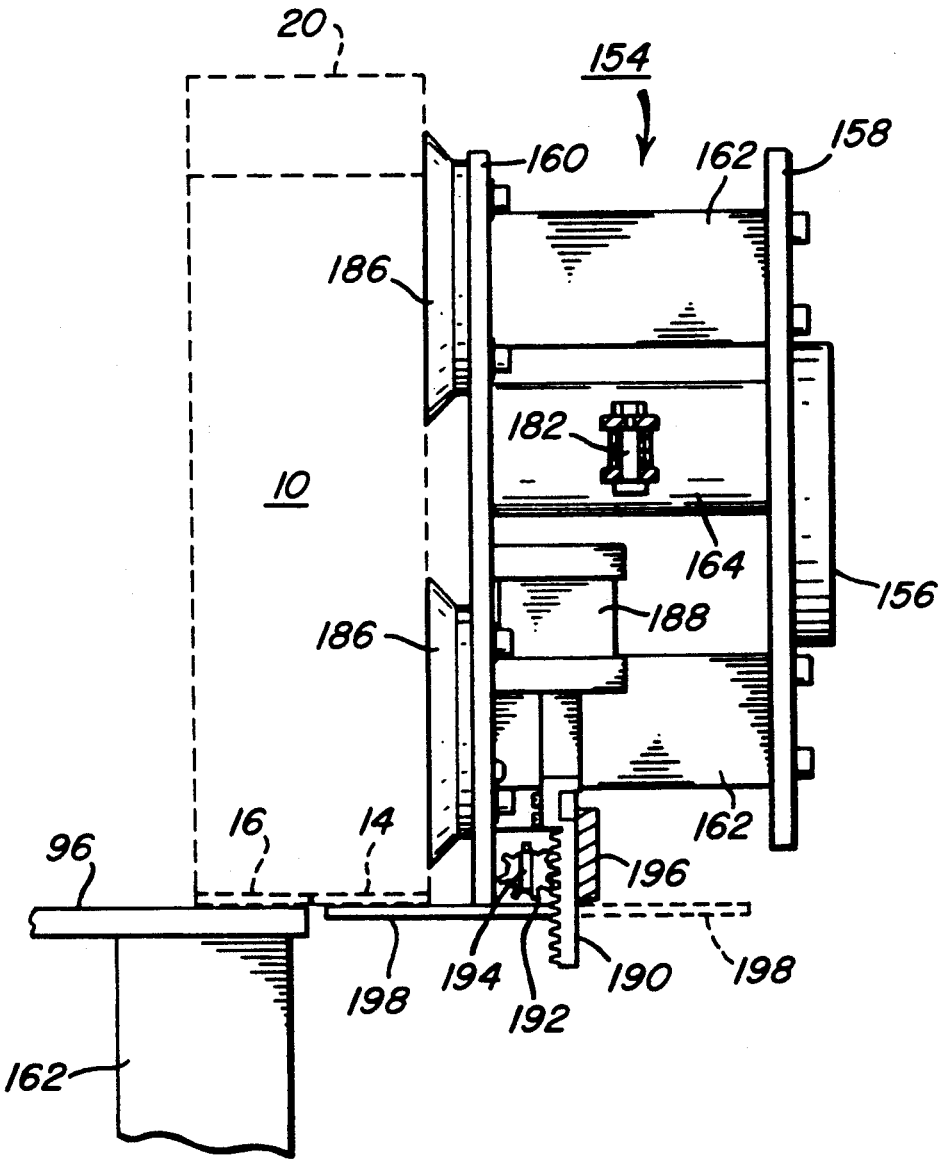
FIG. 18 is an elevation view of the same loaded case after it has been uprighted at the edge of the case locating table.

Once top end flap 14 has been folded downward, side end flaps 18, 20 are held in their folded positions by end flap 14; so that, end flap closing arms 110, 148 can be rotated back to their starting positions and arm 110 can be retracted back into slot 112. Thus, at the one end of the case shown in phantom in FIGS. 16 and 17, only bottom end flap 16 remains to be closed; while at the other end of the case, all of the end flaps remain open. FIGS. 17 and 18 show how robot 44 is repositioned to close the remaining bottom end flap 16. Robot 44 slides the case and its contents from the position of FIG. 17 toward the edge of top plate 96 closer to robot 44. At the same time, robot 44 rotates the case clockwise, as illustrated, about the corner hinge 200 between the remaining bottom end flap 16 and the bottom panel 12 until the upright position of FIG. 18 is reached. In the illustrated upright position, top flap closing arms 198 are positioned beyond the edge of top plate 96, while the edge of top end flap 14 is captured between the upright case and top plate 96. Then actuator 188 retracts its rod to pivot top flap closing arms 198 approximately 180 degrees to the position illustrated in phantom in FIGS. 15, 17 and 18. With arms 198 out of the way, robot 44 can then slide the upright case across the surface of top plate 96, onto the coplanar surface of an adjacent transfer table 202 and on to taping station 46, where the remaining end flaps are folded in a conventional manner and both sets of end flaps are taped to seal the package.

While our invention has been shown and described with reference to particular embodiments thereof, those skilled in the art will understand that other variations in form and detail may be made without departing from the scope and spirit of our invention.

Having thus described our invention in sufficient detail to enable those skilled in the art to make and use it, we claim as new and desire to secure Letters Patent for:

1. A method for packaging objects, comprising the steps of:

providing a series of a plurality of different types of such objects;

providing a first source of a plurality of different types of cases for receiving such objects, such cases being collapsed at said first source;

storing information on the order of such objects in such series to be provided;

providing a programmable robot of the type having an end effector with a multiple purpose tool;

using said multiple purpose tool in response to said information for (a) selecting a type of case from said first source appropriate for such objects in such series, (b) placing such type of case at a position for erection prior to receiving such objects and (c) erecting such type of case at said position after said placing;

inserting such objects into such type of case; and closing such case following said inserting.

2. A method according to claim 1, wherein said inserting step is performed using said multiple purpose tool.

3. A method according to claim 1, further comprising the steps of:

providing a second source of dunnage inserts for such cases to accommodate different types of such objects;

holding such dunnage inserts in position for insertion into such cases simultaneously with such objects; and using said multiple purpose tool for selecting appropriate dunnage inserts from said second source; and inserting such dunnage inserts into such cases simultaneously with such objects.

4. A method according to claim 3, wherein said inserting of such dunnage inserts is performed using said multiple purpose tool.

5. A method according to claim 1, further comprising the step of pushing such cases away from said position for erection after said inserting step to a position at which said closing step is performed.

6. Apparatus for packaging objects, comprising:

means for providing a series of a plurality of different types of such objects;

a first source of a plurality of different types of cases for receiving such objects, such cases being collapsed at said first source;

means for storing and providing information on the order of such objects in said series to be provided;

means for locating such cases at a position for erection prior to insertion of such objects;

a programmable robot, responsive to said means for storing and providing, said robot comprising an end effector with multiple purpose tool means for (a) removing a type of case from said first source appropriate for said order of such objects in said series, (b) transferring such type of case from said first source to said means for locating and (c) erecting such type of case at said means for locating;

means for inserting such objects into such type of case; and means for closing such type of case following such inserting.

7. Apparatus according to claim 6, wherein said means for inserting is comprised in said multiple purpose tool means.

8. Apparatus according to claim 6, further comprising:

a second source of dunnage inserts for such cases to accommodate different types of such objects;

means for holding such dunnage inserts in position for insertion into such type of case simultaneously with such objects;

wherein said multiple purpose tool means also performs the functions of (d) selecting appropriate dunnage inserts from said second source and (e) placing such dunnage inserts at said means for holding; and means for inserting such dunnage inserts from said means for holding into such cases simultaneously with such objects.

9. Apparatus according to claim 8, wherein said means for inserting such dunnage inserts is comprised in said multiple purpose tool means.

10. Apparatus according to claim 6, wherein said means for locating comprises a surface across which said means for inserting pushes such cases following such inserting; such cases comprise at each end at least one end flap to be closed following such inserting; and said means for closing comprises at least one pivotable closing arm spaced across said surface from said position for erection and means for rotating said closing arm to close said end flap at one end of such cases when such cases have been pushed across said surface.

* * * * *